US005379476A

United States Patent [19]

Salecker

[11] Patent Number: 5,379,476

[45] Date of Patent: Jan. 10, 1995

[54] SKID ASSEMBLY FOR CONDUIT CLEANER

[75] Inventor: Roy W. Salecker, Mendota, Ill.

[73] Assignee: Spartan Tool Div. of Pettibone Corp., Mendota, Ill.

[21] Appl. No.: 46,158

[22] Filed: Apr. 13, 1993

[51] Int. Cl.[6] ..... B08B 9/02

[52] U.S. Cl. ..... 15/104.31; 15/104.12

[58] Field of Search ..... 15/104.31, 104.12, 104.09, 15/104.13; 134/167 C, 168 C, 166 C, 169 C

[56] References Cited

U.S. PATENT DOCUMENTS

| | | | |
|---|---|---|---|
| 1,036,735 | 8/1912 | Sieben et al. | 15/104.31 |
| 1,163,624 | 12/1915 | Stevenson et al. | 15/104.31 |
| 1,263,733 | 4/1918 | Bassett | 15/104.31 |
| 3,449,783 | 6/1969 | Kirschke | 15/104.12 |
| 3,740,785 | 6/1973 | Latall | 15/104.12 |
| 4,516,286 | 5/1985 | Crane | 15/104.31 |
| 4,766,631 | 8/1988 | Crane et al. | 15/104.31 |

FOREIGN PATENT DOCUMENTS

| | | | |
|---|---|---|---|
| 3427371 | 2/1986 | Germany | 15/104.12 |

*Primary Examiner*—Edward L. Roberts

*Attorney, Agent, or Firm*—Wood, Phillips, VanSanten, Hoffman & Ertel

[57] ABSTRACT

A conduit cleaner having a power unit that at least one of a) drives a cutter for foreign matter and b) discharges a working fluid under pressure to impinge upon a conduit within which the cleaner resides. First and second skids are removably and separately connected to the power unit so that c) the first and second skids can be separated, each from the other and the power unit and d) with the first and second skids in an operative position on the power unit, the first and second skids cooperatively guide movement of the power unit within a conduit.

19 Claims, 4 Drawing Sheets

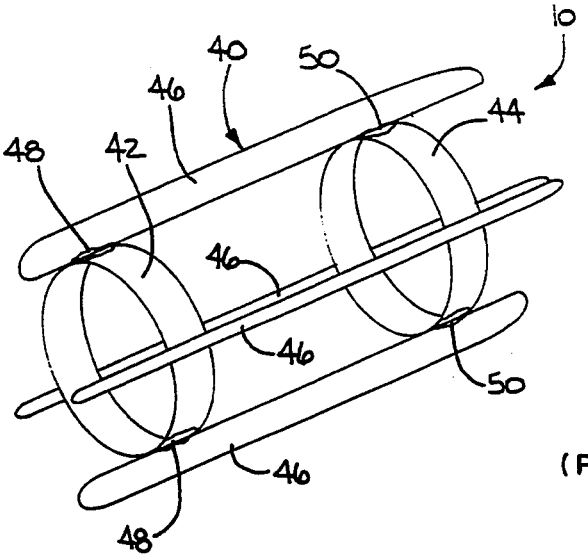
FIG. 1
(PRIOR ART)
FIG. 2
(PRIOR ART)
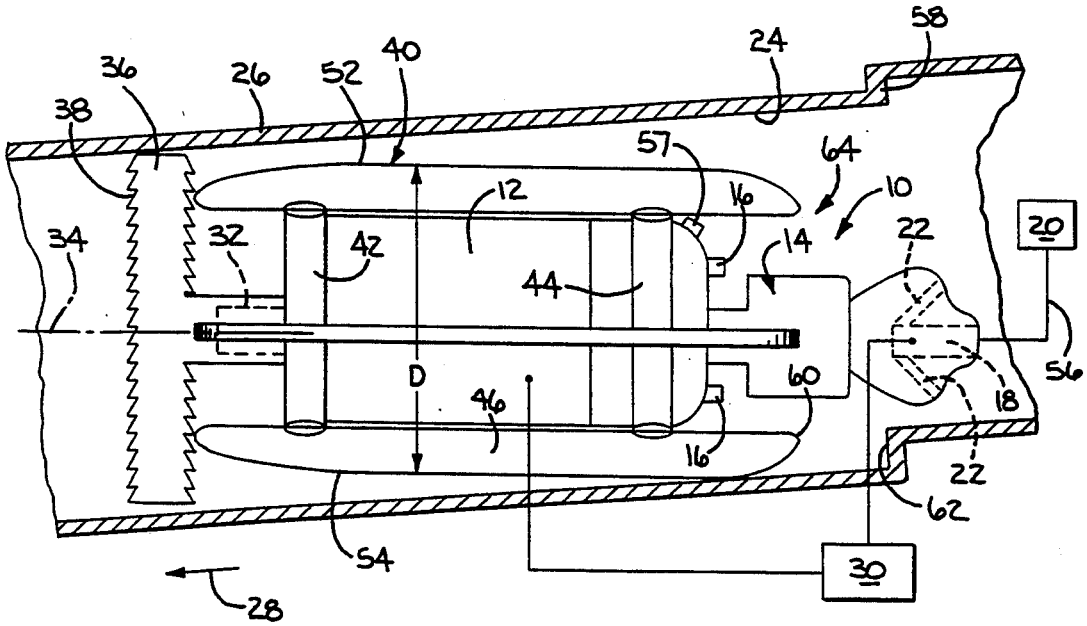

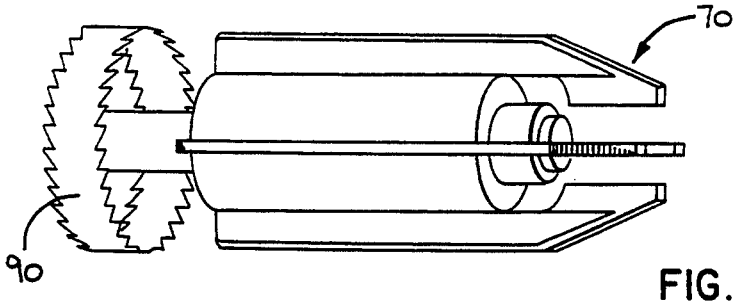
FIG. 3
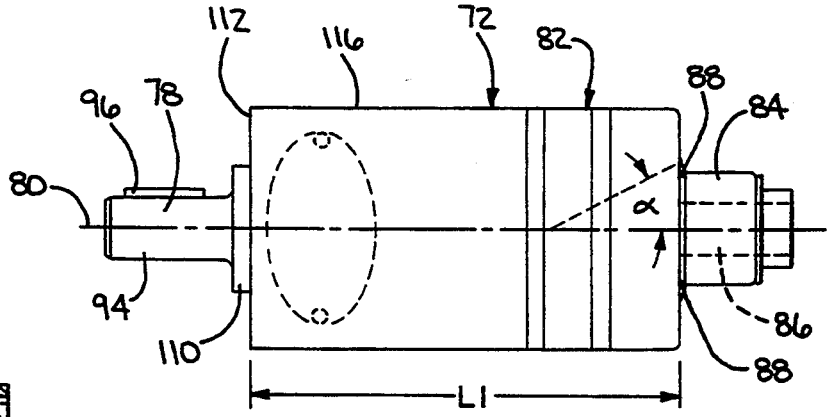
FIG. 4
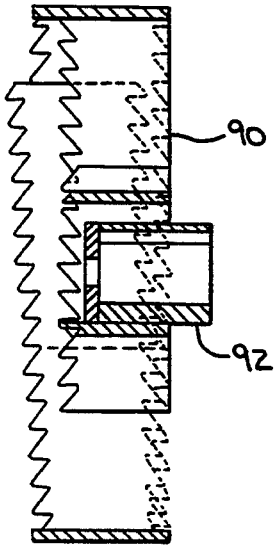
FIG. 5
FIG. 6
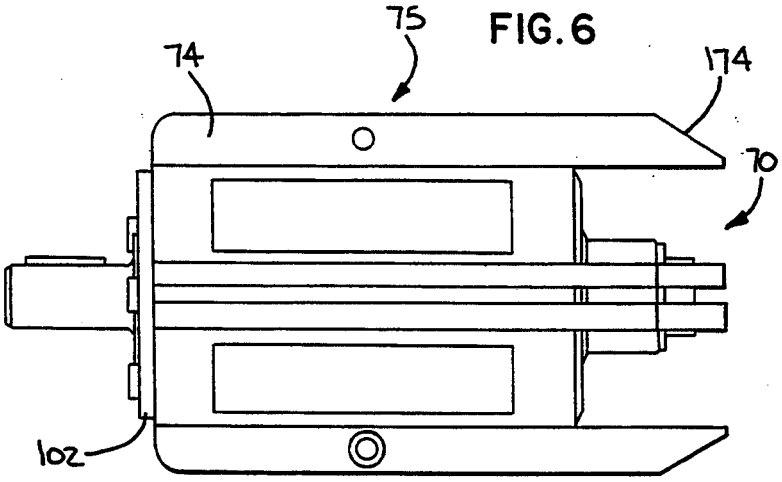

SKID ASSEMBLY FOR CONDUIT CLEANER

BACKGROUND OF THE INVENTION

1. Field of the Invention

This invention relates to a conduit cleaner that at least one of a) breaks up foreign matter within a conduit and b) discharges a fluid under pressure to effect cleaning of the inside walls of a conduit and, more particularly, to a skid assembly that guides movement of the conduit cleaner within a conduit.

2. Background Art

Conduit cleaners, such as those used to sever/break up foreign matter within a conduit and scour the inside walls of a conduit, are well known in the art. One highly successful conduit cleaner is disclosed in U.S. Pat. No. 3,740,785, to Latall.

The Latall conduit cleaner has a subassembly consisting of a thruster section and a motor. High pressure water is delivered to the thruster section and is expelled through jet passages radially outwardly and rearwardly so as to both propel the unit and scour the inside surface of the conduit within which the unit resides. The pressurized water supply simultaneously communicates with the motor to effect operation thereof and cause rotation of a root cutter blade at the leading end of the unit.

To facilitate translation of the unit through a conduit, a cage-like skid assembly is provided, which assembly includes a plurality of circumferentially spaced runners/skids. The runners are elongate in the direction of travel and have radially inturned ends to limit the possibility of hangup as the unit advances in, or is withdrawn from, a conduit.

The runners are fixedly attached to a split clamp through intermediate struts so that the entire skid assembly remains intact as it is assembled to, and disassembled from, the motor/thruster section subassembly. For rigidity, the runners are made from heavy gauge rods that are welded fixedly to the struts, which in turn are welded to the split clamp.

While the Latall unit has been highly successful, there are some drawbacks with the skid assembly. More particularly, the runners on the skid assembly are in fixed relationship so that they cooperatively produce but one effective diameter. In certain environments, it may be desirable to enlarge or diminish the effective diameter of the skid assembly. The Latall unit requires that the skid assembly be separated as a unit and replaced with a different, fully assembled skid assembly having different dimensions.

To separate the skid assembly, a bolt is loosened, which allows the clamp to be enlarged and thereby slid along the motor housing and over the thruster section. This operation requires that the supply line be taken off of the thruster section. Alternatively, the cutting blade assembly at the leading end of the unit can be separated from the driving motor, thereby allowing the skid assembly to shift forwardly off of the unit.

While the removal of one skid assembly and replacement thereof with another skid assembly can be accomplished, this procedure is relatively complicated and time consuming. Several tools are required to disconnect the supply line, remove the cutting blade assembly, and loosen the split clamp. When this change is made out in the field, considerable down time may result.

Another problem with the Latall structure is that, if the effective diameter of the skid assembly is to be altered, the user must keep one or more extra, self-contained skid assemblies on hand. These highly rigid skid assemblies are relatively expensive to manufacture and take up a considerable amount of space.

Another problem with the Latall unit is that it is prone to hanging up on obstructions within the conduit as it is being withdrawn. The unit may, for example, hang up on any step that is in the conduit, on a root, or on severed foreign matter that resides within the conduit.

SUMMARY OF THE INVENTION

The present invention is specifically directed to overcoming the above enumerated problems in a novel and simple manner.

In one form of the invention, a conduit cleaner is provided having a power unit that at least one of a) drives a cutter for foreign matter and b) discharges a working fluid under pressure to impinge upon a conduit within which the cleaner resides. First and second skids are removably and separately connected to the power unit so that c) the first and second skids can be separated, each from the other and the power unit and d) with the first and second skids in an operative position on the power unit, the first and second skids cooperatively guide movement of the power unit within a conduit.

In the event that one or more of the skids is damaged, replacement thereof can be effected without replacing all of the skids. Further, the replacement of one skid with another allows skids of different dimensions to be substituted, as when it is desired to alter the effective diameter of the unit.

In one form, the power unit has a motor and a frame defining a receptacle for the motor, with there being a plate on the frame to which one of the first and second skids is connected. Alternatively, first and second plates can be mounted to the frame to define a space therebetween for reception of one of the first and second skids. This assures positive location of the skids and rigidities the skids to prevent skewing or twisting of the skids in use.

A fastener can be extended at least partially through the plate(s) and the skid which is connected thereto to maintain each skid in its operative position. The fastener could be a bolt that extends partially or fully through the skid and plate(s) or a pin that extends fully through the plate(s) and skid.

In one form, the pin is unthreaded to allow it be pressed into and pulled out of a plate(s) and skid. A key, such as a cotter key, can be attached to the projecting pin end to prevent withdrawal thereof. With this arrangement, the user can simply align a skid with a plate(s), press the pin through aligned bores, and attach the key. By reversing these steps, the skid can be separated from the unit. The only tool required is that which is needed to shape the key.

In one form, one and only one fastener is used for each skid, which further simplifies construction. The space within which each skid resides is bounded by at least one of the frame and motor, which confines pivoting of the skid about the fastener.

In one form, the power unit has an axis and the first and second skids each have a guide edge, with the guide edges on the first and second skids cooperatively defining a first effective diameter with the skids in an operative position. A third skid, having a different configuration, i.e. dimension, than one of the first and second skids, can be substituted therefor to alter the effective diameter of the unit. Virtually an infinite number of different effective diameters can be produced with a single basic power unit.

To facilitate manufacture at a low cost, the individual skids can be formed from flat metal material, as by cutting or stamping. The flat skids can be compactly stored and are sufficiently small to be readily transported. Assembly and disassembly is facilitated. The plate(s) used to attach the skids can be made rigid and with a sufficient radial extent to reinforce the skids to produce a high integrity unit.

Another objective of the invention is to prevent hangup as the cleaner is withdrawn from a conduit. To accomplish this, the skids are configured to project radially inwardly at the trailing end of the power unit to minimize the size of the open space radially inwardly of the skids within which foreign matter can be wedged. In one form, a portion of at least one of the skids projects radially inwardly sufficiently that the radially inwardly facing edge thereof is in close proximity to a nozzle at the trailing end of the power unit or a supply conduit attached to an inlet fitting on the nozzle.

The skids have an inclined outer edge at the trailing end of the unit so that the skids will wedge through foreign matter and guide the unit over an obstruction within the conduit, even as obtrusive as, for example, broken tiles, as the cleaner is withdrawn from a conduit.

A portion of the skid(s) that projects rearwardly at the trailing end of the power unit can be configured to match the contour of the exposed portion of the inlet fitting and/or supply conduit.

Further according to the invention, a conduit cleaner is provided having a power unit with an axis, axially spaced ends, an inlet fitting at one end for accepting a supply conduit, and a peripheral surface. First and second skids can be connected to the power unit in an operative position so that guide edges on the skids cooperatively guide movement of the power unit within a conduit. At least one of the skids has a portion that projects radially inwardly beyond the peripheral surface of the power unit to define an edge that is adjacent to at least one of the inlet fitting and a supply conduit to be connected thereto.

In one form, the radially inwardly facing edge of the skid portion(s) is parallel to the axis of the power unit.

BRIEF DESCRIPTION OF THE DRAWINGS

FIG. 1 is a perspective view of a prior art skid assembly;

FIG. 2 is a side elevation view of the skid assembly in FIG. 1 operatively connected to a motor and thrust section subassembly;

FIG. 3 is a perspective view of a fully assembled conduit cleaner according to the present invention;

FIG. 4 is a side elevation view of one form of motor that can be used with the conduit cleaner in FIG. 3;

FIG. 5 is a cross-sectional view of a cutter head that can be attached to a drive shaft on the motor in FIG. 4;

FIG. 6 is a side elevation view of a power unit subassembly including the motor in FIG. 4 and a frame on which a plurality of skids can be mounted;

DETAILED DESCRIPTION OF THE DRAWINGS

Figure 8:
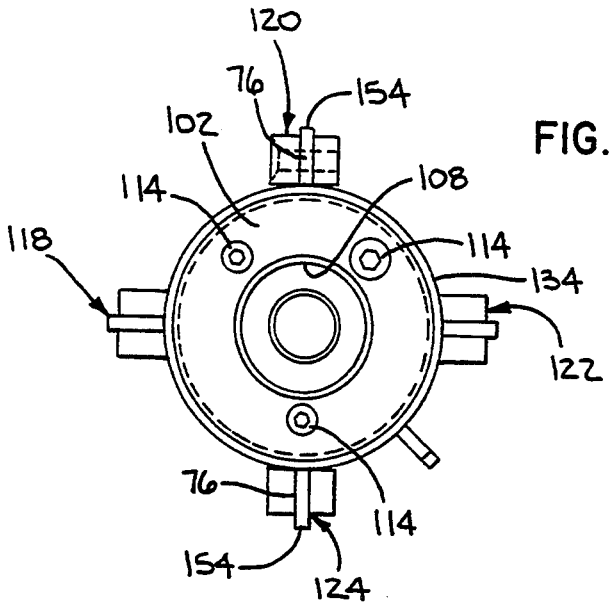
FIG. 8 is a front elevation view of the power unit in FIG. 7 with the skids thereon.

In FIGS. 1 and 2, a prior art conduit cleaner is shown at 10. A detailed description of a similar type of conduit cleaner appears in U.S. Pat. No. 3,740,785, to Latall, which is incorporated herein by reference. Only a brief description of the conduit cleaner 10 will be made herein to set the environment for the present invention.

The conduit cleaner 10 consists of a motor 12 and a thruster section 14 connected to the motor 12 by bolts 16. The thruster section 14 defines a pressure chamber 18 which receives fluid, such as water, from a pressurized supply 20. Pressurized fluid flowing into the chamber 18 is diverted through a plurality of jet passages 22, which direct the fluid angularly against an inside surface 24 of a conduit 26. As the fluid discharges from the jet passages 22, an advancing force in the direction of arrow 28 is developed for the cleaner 10.

Pressurized fluid from the chambers 18 also communicates by a means, shown schematically at 30 in FIG. 2, to the motor 12, to effect rotation thereof. As the motor 12 operates, a shaft 32 at the leading end of the cleaner 10 rotates about the central axis 34 of the unit 10. A cutting blade 36 is keyed to the shaft 32 to rotate therewith and has a plurality of teeth 38 which sever/grind foreign matter within the conduit 26 as the conduit cleaner 10 is advanced and withdrawn.

To guide the conduit cleaner 10 within the conduit 26, a cage-like skid assembly 40 is provided. The skid assembly 40 has axially spaced mounting rings 42, 44, which closely surround the motor 12 and thruster section 14 at axially spaced locations. A plurality of, and in this case four, skids 46, of like construction, are attached to the mounting rings 42, 44 so as to be equidistantly spaced about the circumference of the rings 42, 44. Welds 48 permanently fix the skids 46 to the rings 42, 44 in such a manner that the skids 46 align to be substantially parallel with the axis 34 of the cleaner 10.

The effective diameter D of the cleaner 10 is measured between the diametrically oppositely facing edges 52 on the skid assembly 40. This dimension D is fixed. In the event that it is desired to change the diameter D of the skid assembly 40, the user must slide the skid assembly 40 from the combined motor and thrust section subassembly. Depending upon which direction the skid assembly 40 is to be slid, this requires either the removal of the cutter blade 36 from the shaft 32 or the disconnection of the supply line 56 from the thruster section 14 and the removal of a fluid outlet plug 57, which projects radially beyond the outer surface of the motor 12. It can be seen that either process is quite inconvenient, particularly if the need to change the skid assembly 40 arises in the field. The user is required to keep on hand a series of completed skid assemblies 40 of different dimensions to permit substitution of one skid assembly 40 for another and the necessary tools to effect this change.

Another problem with the prior art skid assembly 40 is that it is prone to hanging up within the conduit 26. In FIG. 2, a step 58 is shown in the conduit 26 that may be created by a fracture or an imperfection during manufacture or assembly. Movement of the conduit cleaner 10 from left to right in FIG. 2 causes the trailing edge 60 on, in this case, the bottommost skid 46, to abut a surface 62 which thereby arrests further left to right movement of the cleaner 10. The surface 62, if it extends as little as 5/8 of an inch, may interfere with the conventional cleaner 10.

Another problem with the prior art cleaner 10 is that there is a substantial annular gap 64 between the skids 46 and the thruster section 14. Foreign matter, such as roots, may find its way into the gap 64 and become entangled with the cleaner 10 so as to prohibit further withdrawal from the conduit i.e. movement from left to right.

In the event that the cleaner 10 hangs up within the conduit 26 as it is being withdrawn, damage may be inflicted to the conduit 26 and/or the cleaner 10 as the user forces the withdrawal of the cleaner 10. The migration of foreign matter into the gap 64 may not only prohibit withdrawal of the cleaner 10, but may also inhibit effective use thereof. It is common when operating the conventional cleaner 10 to allow the cleaner 10 to advance and then to draw it in a rearward direction to scour the conduit wall 24 and break up stubborn obstructions.

The inventive conduit cleaner, which overcomes the above deficiencies in the prior art, is shown at 70 in FIGS. 3–12. The conduit cleaner 70 consists of a motor 72 and a frame 74, which together define a power unit 75. The frame defines a receptacle for the motor 72 as well as a support for individual skids 76, 76', 76". Exemplary skid construction 76 will be used to initially describe the structure and operation of the conduit cleaner 70.

The motor 72 is commercially available through Danfoss Corporation in Rockford, Ill. and sold as its Model OMM 32-151G0033. This motor 72 has a forwardly projecting shaft 78 rotatable about a central axis 80. At the trailing end 82 of the motor 72, a nozzle 84 is attached. The nozzle 84 greatly simplifies and reduces the size of the power unit over those in the prior art and the specific construction thereof is the subject of a separate patent application. It suffices to say that the nozzle 84 defines a pressure chamber 86 which communicates with circumferentially spaced jets 88, which direct pressurized fluid at an angle of approximately 15° to the central axis 80 of the motor 70, as indicated by the angle $\alpha$ in FIG. 4. The cutting blade 90, as shown in FIGS. 3 and 5, has a receptacle 92 for the exposed shaft end 94, which is keyed against rotation by a key 96 on the shaft 78.

As previously indicated, the motor 72 is accepted by the frame 74. The frame 74 has a cylindrical body 98 with an open trailing end 100 and a forward wall 102 closing the leading frame end 104 so that the frame generally defines a cup shape opening in a trailing direction. The motor 72 can be slid from right to left in FIGS. 6 and 7 snugly into the cup-shaped receptacle 106. As also seen in FIG. 8, the wall 102 has a through bore 108 to accommodate both the shaft 78 on the motor 72 and a stepped wall 110 at the leading portion of the motor 72. With the motor 72 fully seated, a surface 112 at the leading portion thereof abuts to the frame wall 102. Three bolts 114 extend through the wall 102 into pre-tapped, blind bores in the motor housing 116 and thereby maintain the motor 72 and frame 74 fixedly together as a unit.

Plate pairs 118, 120, 122, 124 are provided in equidistantly spaced relationship about the body 98 and are secured thereto as by welding. Since all the plate pairs 118, 120, 122, 124 are the same, exemplary plate pair 122 will be described below.

Plate pair 122 consists of axially extending flat plates 126, 128, which are mounted to the frame body 98 so as to define a space 130 therebetween. The space closely receives skids 76, 76', 76", which are made from flat metal stock. In this case, the skid 76 is shown in the space 130.

The skid 76 has a radially inwardly facing edge 132 that abuts to the peripheral surface 134 of the frame body 98, which surface 134 bounds the space 130. With the skid 76 fully seated in the space 130 in its operative position, a bore 136 through the skid 76 aligns with coaxial bores 138, 140 in the plates 126, 128, respectively. This allows a fastener 142, in this case an unthreaded pin, to be pressed through the aligned bores 136, 138, 140. The pin has an enlarged head 144 which seats in an undercut 146 in the plate 126. With the pin 142 fully seated, the free end 148 thereof, remote from the head 144, is exposed beyond the plate 128. The end 148 has a bore 150 therethrough to accept a conventional cotter pin 152 that can be passed therethrough and deformed, as shown for the plate pair 120 in FIG. 7.

It can be seen that the power unit 75 serves as a universal mount for all of the skids 76, 76', 76". Consequently, the user is allowed great flexibility in terms of repair and/or reconfiguration of the entire unit 70. If any one of the skids 76, 76', 76" should become damaged, by simply removing the cotter pin 152 and fastener 142, the damaged skids 76, 76', 76" can be separated from the power unit and replaced. Only a single tool is required to effect this operation, that being a tool to deform the cotter pin 152. At the same time, the skids 76, 76', 76" are interchangeable on the power unit 75 so that the effective diameter defined between the outermost edges 154, 154', 154" can be selected.

Figure 12:
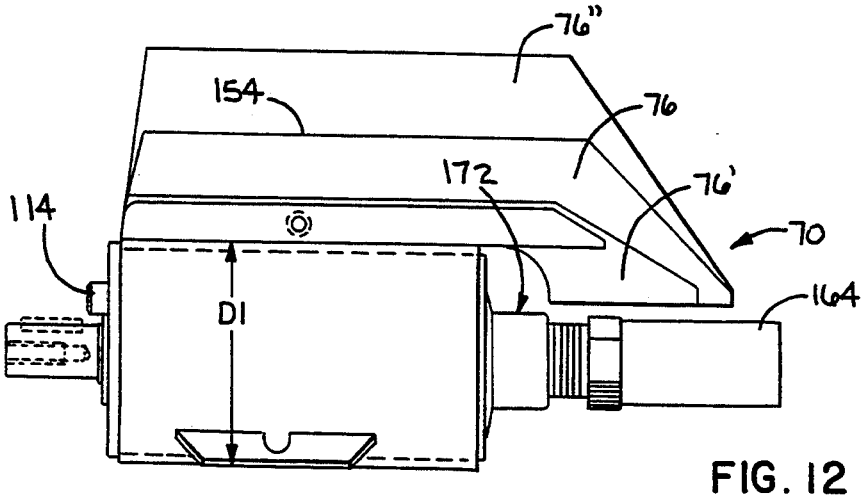
FIG. 12 is a side elevation view of the inventive power unit with the skids in FIGS. 9–11 shown attached thereto in superimposed relationship.
Figure 9:
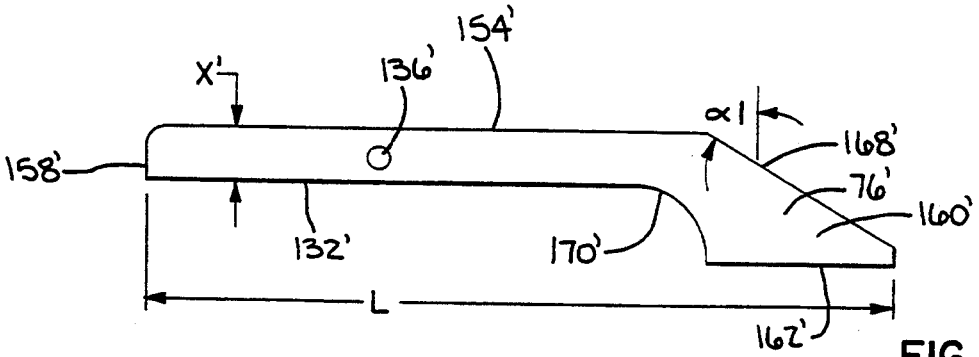
FIG. 9 is a side elevation of one form of skid according to the present invention.
Figure 10:
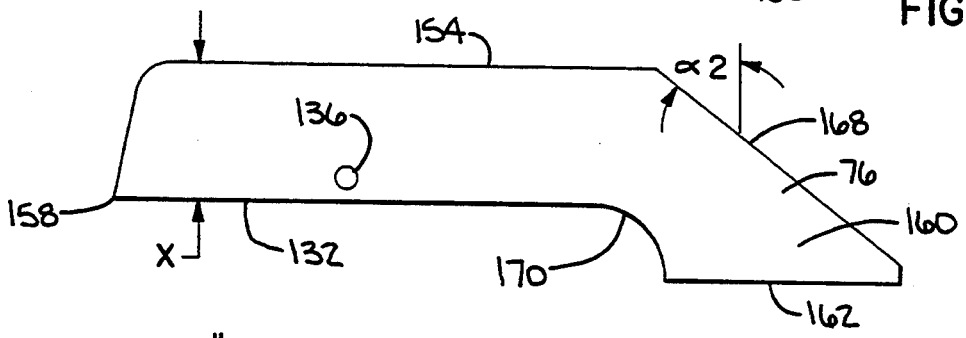
FIG. 10 is a side elevation of a modified form of skid according to the present invention.
Figure 11:
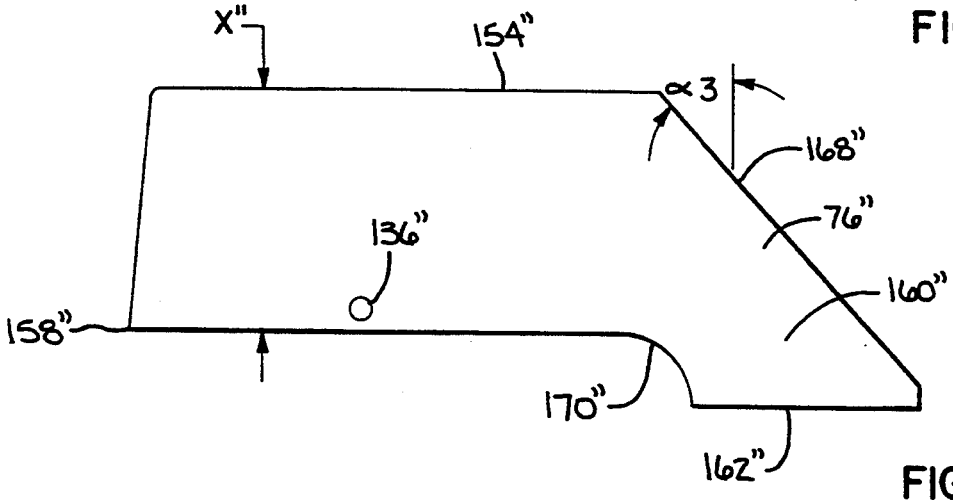
FIG. 11 is a side elevation view of a still further modified form of skid according to the present invention.

The skids 76, 76', 76" produce effective diameters that are commonly used in the field. In FIG. 12, each of the skids 76, 76', 76" is shown in an operative position on the power unit. The peripheral surface 134 of the power unit has a diameter D1 equal to approximately $3\frac{1}{2}$ inches. It should be understood that this dimension as well as the others that are described below are merely exemplary. The skid 76 has a dimension X between the edge 132 that abuts to the power unit and the outside edge 154 of $1\frac{1}{4}$ inches. Thus the effective overall diameter of the conduit cleaner 70, with the skids 76 thereon, is approximately 6 inches. The dimension X' in FIG. 9, corresponding to the dimension X in FIG. 10, is equal to $\frac{1}{2}$ inch so that the overall effective diameter of the cleaner 70 is approximately 6 inches. A corresponding dimension X" in FIG. 11 for the skids 76" is $2\frac{1}{4}$ inches to that the overall effective diameter of the cleaner 70 with the skids 76" thereon is 8 inches.

Each of the skids 76, 76', 76" has an overall length L equal to approximately $7\frac{1}{4}$ inches. The power unit has a uniform diameter extending from the leading surface 112 rearwardly a distance L1, which is equal to approximately $4\frac{1}{2}$ inches. The skids 76, 76', 76", in their operative position, have leading edges 158, 158', 158" that align axially with the front surface 112 of the motor 72. This results in rearward extension of the skids beyond that portion of the power unit with the uniform diameter a distance L2 in FIG. 7 that is equal to approximately $2\frac{3}{4}$ inches.

Figure 7:
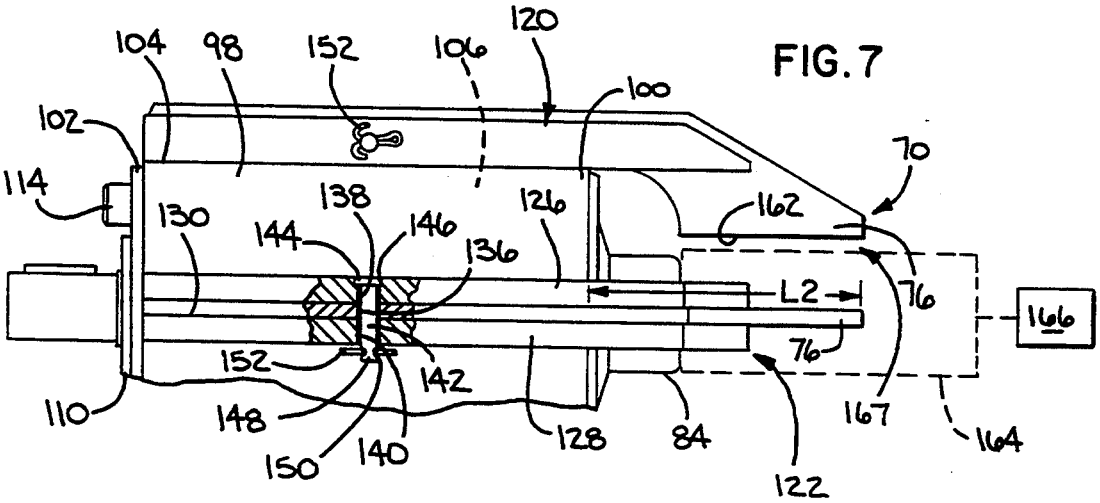
FIG. 7 is a fragmentary side elevation view of the power unit in FIG. 6 with skids attached thereto according to the invention and showing pins used to maintain the skids on the power unit.

The skid portions 160, 160', 160'' that project rearwardly beyond that portion of the power unit 76 with the uniform diameter are radially thickened to project radially inwardly beyond the peripheral surface 134 of the power unit. The inwardmost edges 162, 162', 162'' of the skids 76, 76', 76'' project substantially parallel to the motor axis 80 and reside adjacent to a supply conduit 164 which connects to the nozzle 84 and communicates fluid from a supply 166 to the nozzle 84. As can be seen in FIG. 7, only a small annular gap 166 exists between the conduit 164 and the skids 76, 76', 76'' so that foreign matter cannot migrate through the gap 166 into the space between the conduit 164 and the skids 76, 76', 76'' as might prohibit withdrawal of the cleaner 70.

To further prevent hangup of the conduit cleaner 70, the edge 154, 154', 154'' has an inclined length 168, 168', 168''. The angle of inclination $\alpha 1$ for the length 168' is on the order of 60°. The angle of inclination $\alpha 2$ for the skid 76 is approximately 53°, with the corresponding angle $\alpha 3$ for the skid 76'' being approximately 40°. With the skids 76, 76', 76'' in operative relationship, they cooperatively produce a conical shape that converges in a trailing direction. Thus, as the user draws on the conduit 164, the skids 76, 76', 76'' wedge through foreign matter. The edge lengths 168, 168', 168'' also ride readily over steps or other buildups in the conduit 26.

The skids 76, 76', 76'' have an arcuate, inner edge 170, 170', 170'' that conforms generally to the outer surface 172 of the nozzle 84. The plate pairs 118, 120, 122, 124 project in a trailing direction approximately the same distance as the skids 76, 76', 76'' to provide reinforcement therefor. The skids have inclined edges 174 at approximately the same angle as the edge lengths 168, 168', 168''. In one form, the skids 76, 76', 76'' are made from ten gauge HRPO Steel.

The foregoing disclosure of specific embodiments is intended to be illustrative of the broad concepts comprehended by the invention.

I claim:

1. A conduit cleaner comprising:

means operated by a power unit for clearing foreign matter within a conduit, said power unit including a motor having an axis and a frame defining a receptacle for the motor;

a first skid with an elongate edge and having axially spaced ends; and first means for removably connecting the first skid to the power unit with the elongate edge facing radially inwardly relative to the motor axis and located adjacent to the power unit so that c) the first skid can be separated from the power unit and d) with the first skid in an operative position on the power unit the first skid guides movement of the power unit within a conduit, said first means including a first plate on the power unit and one and only one fastener extending at least partially through the first skid between the axially spaced ends thereof and the first plate, whereby pivoting of the first skid about the one fastener is limited by the power unit which is abuttable to the elongate skid edge.

2. The conduit cleaner according to claim 1 wherein the first means includes a second plate mounted to the power unit so that a space is defined between the first and third plates for reception of the first skid with the first skid in its operative position, said one fastener being extendable at least partially through the second plate.

3. The conduit cleaner according to claim 2 wherein there is a radially outwardly facing surface bounding the space, said radially outwardly facing surface is defined by at least one of the motor and frame and the one skid abuts to the radially outwardly facing surface with the one skid in its operative position.

4. The conduit cleaner according to claim 1 wherein the fastener comprises an unthreaded pin that extends fully through the first skid.

5. The conduit cleaner according to claim 4 in combination with a key and wherein the pin includes means for cooperating with the key to prevent therefor withdrawal of the pin from the one of the first and second skids, whereby a user can assemble the pin and thereafter attach the key to the pin to prevent withdrawal of the pin.

6. The conduit cleaner according to claim 1 wherein the power unit has axially spaced ends and a peripheral surface, the first skid is configured so that with the first skid in its operative position a portion of the first skid projects substantially radially inwardly beyond the peripheral surface of the power unit at one end thereof.

7. The conduit cleaner according to claim 6 wherein there is an inlet fitting for the power unit at the one end of the power unit for accepting a supply conduit and the portion of the one skid has a radially inwardly facing edge that is in close proximity to at least one of the inlet fitting and a supply conduit to be connected to the inlet fitting so that foreign matter cannot readily wedge between the portion of the one of the first and second skids and the one of the inlet fitting and a supply conduit to be connected to the inlet fitting.

8. The conduit cleaner according to claim 7 wherein said edge on the portion of the one skid is substantially straight and parallel to the axis of the power unit.

9. The conduit cleaner according to claim 7 wherein the one end the power unit has an exposed surface and the one skid is configured to match the contour of the exposed surface at the one end of the power unit.

10. A kit comprising:

a) a conduit cleaner comprising:

means operated by a power unit for clearing foreign matter within a conduit, said power unit including a motor having an axis and a frame defining a receptacle for the motor;

a first skid with an elongate guide edge and having axially spaced ends; and first means for removably connecting the first skid to the power unit with the elongate edge facing radially inwardly relative to the motor axis and located adjacent to the power unit so that c) the first skid can be separated from the power unit and d) with the first skid in an operative position on the power unit the first skid guides movement of the power unit within a conduit, said first means including a first plate on the power unit and one and only one fastener extending at least partially through the first skid between the axially spaced ends thereof and the first plate, whereby pivoting of the first skid about the one fastener is limited by the power unit which is abuttable to the elongate skid edge; and b) a second skid having a guide edge, said second skid having means cooperating with the first connecting means so that the second skid can be placed in an operative position in place of the first skid on the power unit, the guide edge on the second skid in the operative position being spaced from the motor axis a distance different than the guide edge on the first skid is spaced from the motor axis with the first skid in the operative position.

11. A conduit cleaner comprising:

means operated by a power unit for clearing foreign matter within a conduit;

said power unit having an axis, axially spaced ends, an inlet fitting for the power unit at one end for accepting a supply conduit, and a peripheral surface;

first and second skids each having a guide edge; and first means for connecting the first and second skids in an operative position to the power unit so that the guide edges on the first and second skids cooperatively guide movement of the power unit within a conduit, each of said first and second skids having a portion that projects substantially radially inwardly beyond the peripheral surface of the power unit to define a second edge that is adjacent to at least one of the inlet fitting and a supply conduit connected thereto so that foreign matter cannot readily wedge between the portion of the first and second skids and the one of the inlet fitting and a supply conduit to be connected thereto as the power unit moves axially with the one end in a leading position.

12. The conduit cleaner according to claim 11 wherein at least one of the first and second skids is made at least partially from a flat material and the second edge on the one skid has a substantially straight portion that extends substantially parallel to the power unit axis.

13. The conduit cleaner according to claim 11 wherein the first means comprises at least one plate having an axially extending surface to which at least one of the first and second skids is connected.

14. The conduit cleaner according to claim 13 wherein the plate extends axially beyond the inlet fitting at the one end of the power unit.

15. The conduit cleaner according to claim 14 wherein the plate has an outer edge length that makes an acute angle with the axis of the power unit.

16. The conduit cleaner according to claim 11 wherein the first means comprises first and second axially extending plates on the power unit, said plates being spaced from each other to define a space for one of the first and second skids.

17. The conduit cleaner according to claim 16 wherein the first means includes a fastener extending at least partially through the first and second plates and the one of the first and second skids.

18. The conduit cleaner according to claim 16 wherein there is one and only one fastener extending through the first and second plates and the one of the first and second skids.

19. The conduit cleaner according to claim 11 wherein the one end of the power unit is the rear/trailing end thereof, one of the first and second skids has a rearwardmost point and there is no surface on the one skid that is inclined so as to guide any foreign matter encountered by the one skid at the rearwardmost point radially inwardly as the power unit moves axially with the one end in a leading position.

* * * * *